United States Patent [19]

Hays

[11] 4,444,356

[45] Apr. 24, 1984

[54] WINDOW ENVELOPE MODIFIER

[76] Inventor: Walter L. Hays, 1800 Berkeley Ave., St. Paul, Minn. 55105

[21] Appl. No.: 335,823

[22] Filed: Dec. 30, 1981

[51] Int. Cl.[3] ..... B65D 27/04

[52] U.S. Cl. ..... 229/71; 229/72; 229/68 R; 229/92.3; 206/232

[58] Field of Search ..... 229/69, 71, 72, 92.5, 229/92.3, 68 R; 206/232, 390, 389, 408, 813, 820

[56] References Cited

U.S. PATENT DOCUMENTS

| | | | |
|---|---|---|---|
| 331,355 | 12/1885 | Williams | 229/72 |
| 1,214,867 | 2/1917 | Young | 229/71 |
| 1,470,291 | 10/1923 | Sawdow | 229/72 |
| 1,558,306 | 10/1925 | Snape | 229/72 |
| 1,559,132 | 10/1925 | Trenchard | 229/72 |
| 1,668,985 | 5/1928 | Simpson | 229/72 |
| 2,055,716 | 9/1936 | Berkowitz | 229/72 |
| 3,111,256 | 11/1963 | Hiersteiner | 229/72 |
| 3,550,841 | 12/1970 | Berkley | 229/71 |
| 3,592,381 | 7/1971 | Brody | 229/72 |
| 3,784,185 | 1/1974 | Katz | 229/72 |
| 3,905,545 | 9/1975 | Juszak et al. | 206/232 |
| 4,008,852 | 2/1977 | Davis | 229/92.3 |

*Primary Examiner*—Joseph Man-Fu Moy
*Assistant Examiner*—David Fidei
*Attorney, Agent, or Firm*—Dorsey & Whitney

[57] ABSTRACT

A window envelope modifier can be assembled with a document which, when prepared for mailing, may be shorter than the inside length of a window envelope or narrower than the inside height of the envelope. The modifier prevents shifting of the document within the envelope during handling and mailing to an extent which might prevent the usual recipient's address on the document from being easily seen through the envelope window.

The modifier has a body portion with opposite ends and a transverse strip of contact adhesive spaced between such ends and closer to one end than to the other. A premarked or prescored fold line is located between the adhesive strip and the other opposite end. A removable protective strip may cover the adhesive strip prior to use. The modifier is capable of use in either flat or preferably folded form and may be provided as separate individual sheets or as severable portions of a continuous supply roll.

3 Claims, 6 Drawing Figures

WINDOW ENVELOPE MODIFIER

BACKGROUND OF THE INVENTION

The invention relates to modifiers for use with window envelopes for the purpose of maintaining a preaddressed document within such an envelope in a position where the address will show at all times through the customary transparent window portion of the envelope.

Window envelopes can be obtained economically is standard sizes. The documents to be enclosed in such window envelopes may not always be of essentially the same dimensions as the inside of such envelopes, since such documents may be standard forms originally produced most economically in other standard sizes. Such documents, for example, when prepared for mailing in either folded or unfolded form, may be shorter than the inside length of such an envelope or narrower than the vertical height of the inside of the envelope, or both. If there is too much difference in the relative dimensions, the inserted document may slide out of position during mailing and transportation, so that the receipient's address is no longer in proper alignment with the usual transparent window of such an envelope. While envelopes might be manufactured on a custom basis to fit any particular document size to be mailed, such custom manufacturing may be proportionately too costly for use in a situation where a limited number of existing documents are to be mailed and where such documents do not fit rather closely within the dimensions of a standard economical window envelope.

SUMMARY OF THE INVENTION

The present invention accordingly provides a window envelope modifier for positioning a document of one size within a standard window envelope which is substantially larger in at least one of its interior dimensions than the corresponding dimensions of the document to be mailed, when such document has been prepared for mailing with the address of the recipient shown thereon. Thus the document to be mailed can be placed within the envelope with at least one of its longitudinal and vertical edges aligned and in engagement with the corresponding inside edge of the window envelope. The modifier is then adapted for use when such a window envelope has at least one pair of its opposite longitudinal and vertical inside edges spaced substantially further apart than the spacing between the corresponding aligned edge and opposite edge of the document in a direction perpendicular to such aligned edge.

The window envelope modifier of the invention includes a flat body portion having a construction and shape adapted to overlie a portion of the document along an edge thereof which is opposite to the aligned edge, i.e. the edge which is aligned with the corresponding inside edge of the window envelope. This body portion is provided with a retaining means for holding the document with its one edge in such aligned engagement, and the retaining means preferably includes a strip of precoated adhesive on one surface of the flat body portion and a removable protective cover strip initially adhered to and protecting said precoated adhesive strip and manually removable therefrom to expose the adhesive strip for use. The adhesive strip is positioned on the body portion of the modifier at a location for engagement with at least one of the document and envelope members to prevent shifting of the document away from the aligned inner edge of the envelope to a location where the address on the document is not fully visible through the window opening.

In a preferred form of the invention, the modifier has a premarked fold line for folding the body portion on itself in one direction to provide opposed inner surfaces connected by a folded edge section for receiving the document edge which is opposite to such an aligned document edge and to provide opposite outer surfaces for gripping engagement to hold each aligned document edge temporarily within the folded edge for insertion of the modifier and document into aligned position inside the window envelope. The precoated adhesive strip and removable cover strip are positioned on the body portion of such a modifier using a line parallel to the premarked fold line, and such strip and cover are located on the surface which is to constitute one of the opposite outer surfaces of the folded modifier for adhesive engagement of the uncovered adhesive strip with an inner surface of the envelope, when the assembled modifier and document have been inserted therein to the desired aligned position.

Such a modifier can also be used in unfolded form, by overlapping the non-adhesive portion of the modifier with the document edge which is opposite to the edge to be aligned within the envelope, and with the adhesive strip of the modifier on the same surface of the modifier as the surface which is to be overlapped with the document itself and in a position where such adhesive strip can then engage the inner surface of the envelope to provide an adhesively-sealed retaining flap to prevent movement of the document away from the envelope edge with which it has been aligned during insertion of the combined document and modifier.

While the modifier can be constructed of reasonably thin sheet material to function in the above manner, it may also be formed of slightly stiff or rigid paperboard in which the premarked fold line described above can be made in the form of a prescored fold line in such paperboard to facilitate the folding of such thicker and stiffer material without tearing it at the fold line.

Other features of construction and use of the window envelope modifier will be apparent from the following further description.

BRIEF DESCRIPTION OF THE DRAWINGS

In the drawings which form a part of this application, and in which like reference characters indicate like parts.

DESCRIPTION OF THE PREFERRED EMBODIMENTS

Figure 1:
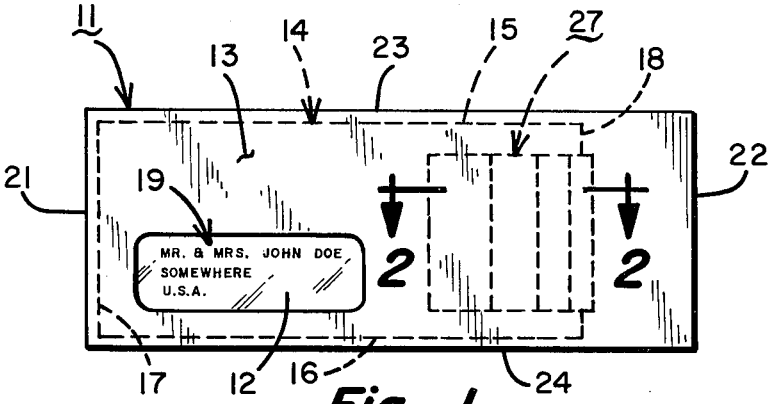
FIG. 1 is a front view of a window envelope, with details of an inserted document and a window envelope modifier according to the present invention shown in phantom outline therein.
Figure 2:
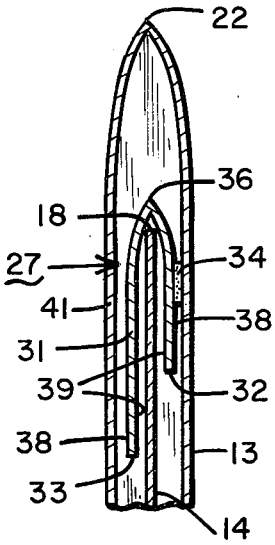
FIG. 2 is a sectional view on the line 2—2 of FIG. 1.
Figure 3:
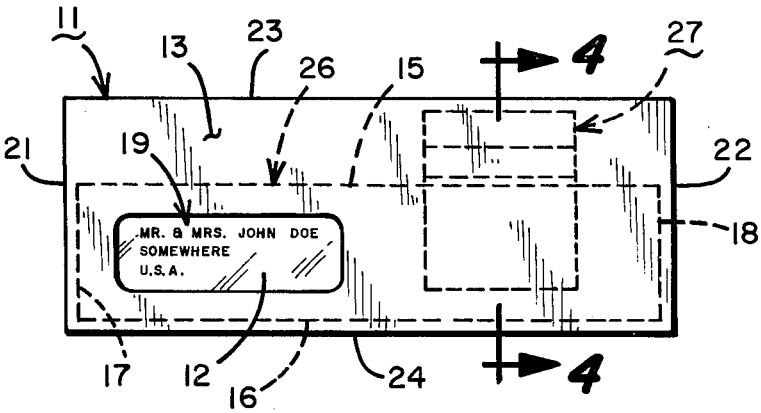
FIG. 3 is a view similar to FIG. 1 showing another application of the window envelope modifier to an inserted document of different size and shape.

The window envelope modifier of the present invention is designed for use in connection with a window envelope 11 of the type shown in FIGS. 1 and 3. Such an envelope includes a transparent window area 12 in the front wall 13 of the envelope. A suitable document or mailer is to be inserted within such a window envelope as shown at 14 in FIG. 1 and at 26 in FIG. 2. Such an inserted document has upper and lower longitudinal edges at 15 and 16 respectively, and left and right vertical edges as shown at 17 and 18. The document also carries the recipient's address 19, which is visible through the window portion 12 when the document is assembled within the envelope.

Figure 5:
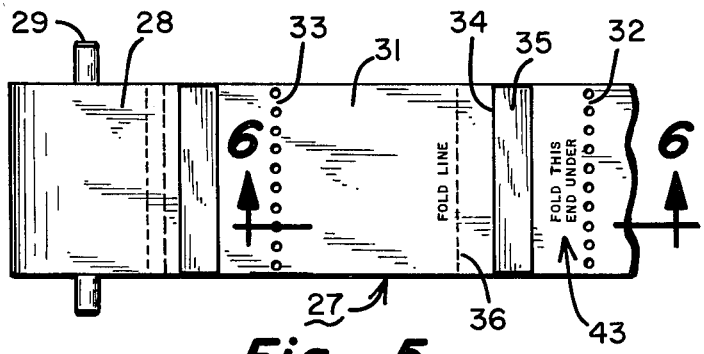
FIG. 5 is a top view of a portion of a continuous strip of window envelope modifiers as available from a suitable supply roll.
Figure 6:
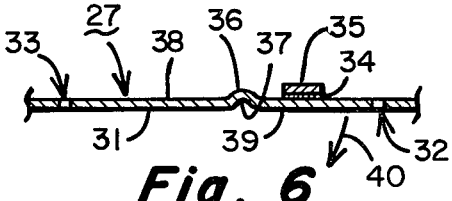
FIG. 6 is a partial sectional view on the line 6—6 of FIG. 5, showing details of a window envelope modifier which can be separated from such a supply roll.

The envelope itself has left and right edges 21 and 22 and upper and lower edges 23 and 24. If a standard window envelope is to be used for mailing a document which has shorter edges either longitudinally (as in FIG. 1) or vertically (as in FIG. 3) than the corresponding inside edge dimensions of the envelope itself, there is a possibility of relative movement of the document within the envelope during handling and mailing, such that the recipient's address 19 may not be clearly visible through the transparent window 12. To prevent such undesired relative movement, a window envelope modifier is shown in the form of a rectangular sheet, which may be manufactured and provided as one of a plurality of single or individual sheets, or which can be produced as shown in FIGS. 5 and 6 as parts of a continuous supply roll of flexible stock such as paper or thin paperboard. Such a supply roll is shown at 28 in FIG. 5 and is supported for rotation as shown schematically by spindle 29. Each modifier on such a roll includes a flat rectangular body portion 31 which has a pair of opposite longitudinal edges constituting the longitudinal edges of the supply roll sheet. A first end edge 32 is defined by one side of a corresponding preperforated tear line. A second preperforated tear line defines the opposite or second end edge 33 of the body portion 31.

The modifier includes suitable retaining means 34 which consists of a precoated narrow strip of relatively sticky contact adhesive extending fully across the body portion 31 at a location spaced substantially closer to the first end edge 32 than to the other edge 33. A removable protective cover strip 35 protects the adhesive layer 34 from premature engagement with any undesired surface, prior to the time when the cover strip is to be removed and the modifier assembled with the mailing document for insertion into the window envelope in one of the manners illustrated in FIGS. 1 and 3.

The modifier body portion also includes a premarked fold line 36, which is parallel to the end edges 32 and 33 and to the precoated adhesive strip 34. The premarked fold line may be provided as a prescored fold line 37, when the body portion 31 is made of paperboard stock having a thickness greater than ordinary writing or document paper, i.e. a thickness which might make it difficult to fold the body portion accurately along the premarked fold line without tearing or fracturing the fiber structure of the paperboard. The fold line is positioned at a location spaced from and in between the adhesive strip 34 and end edge 33 and closer to edge 32 than to the other edge 33.

Thus the premarked or prescored fold line is preferably located closer to the end of the modifier body portion which carries the adhesive strip 34 than to the opposite end of the body portion. The body portion is then designed to be folded on itself so that upper surface 38 which carries the precoated adhesive is on the outside of the folded modifier, while the lower surface 39 of the body portion is folded against itself in the direction shown by the arrow 40 in FIG. 6, when it is desired to use the modifier in the manner illustrated in FIGS. 1 and 2. As shown in those figures, the folded modifier is placed over the right vertical edge 18 of the document, so that the document can actually be retained within the folded modifier when the latter is gripped, for example, between the fingers of a user and held in such assembled position for removal of the protective cover strip 35. The assembled document and modifier, can then be inserted into the window envelope with the left edge 17 of the document properly aligned against the left edge 21 of the envelope, and with the uncovered adhesive strip 34 manually placed in adhesive engagement with the front wall of the envelope. The document is then retained within the folded edge 36 of the window envelope modifier, so that it cannot move to the right in FIG. 1 to slide the recipient's address partway to the right where it might no longer be seen through window 12. A suitable instruction legend 43 is marked on upper surface 38 of modifier 27 as shown in FIG. 5 to insure proper folding of the end 32 and adhesive strip 34 at fold line 36 for use as in FIGS. 1 and 2.

Figure 4:
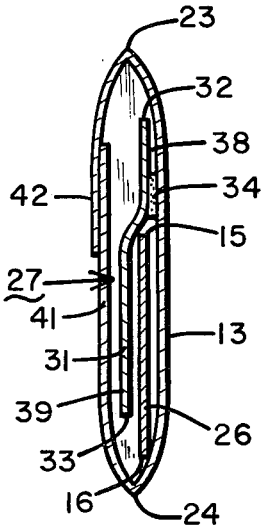
FIG. 4 is a sectional view similar to FIG. 2 on the line 4—4 of FIG. 3.

FIGS. 3 and 4 illustrate the manner in which a similar window envelope modifier can be used in flat or unfolded form for the same purpose. In this case the lower edge 16 of the document is to be aligned inside the lower edge 24 of the envelope, while the upper edge 15 of the document is spaced a substantial distance below the upper edge 23 of the envelope. To prevent the document from sliding upwardly so that the address might no longer be visible through window 12, the window envelope modifier 27 can be used in flat form by placing the uncoated portion of its surface 38 against the back side of the document, so that the protective adhesive strip extends longitudinally just above the document edge. The cover strip can then be removed and the assembled document and modifier inserted downwardly into the window envelope and pressed against the front wall of the envelope, so that the adhesive strip 34 bonds the modifier body portion to the front envelope wall and provides a pocket or limiting edge to prevent upward movement of the upper edge 15 of the document.

Thus a suitable retaining pocket is formed between the window envelope modifier and the front wall of the envelope, where it will not interfere in any way with the normal sealing of the window envelope by the usual adhesive connection between the rear wall 41 of the envelope and an appropriate sealing flap 42 (FIG. 4).

It will be understood that, depending on the relative differences in vertical or longitudinal dimensions between the inside of the window envelope and the corresponding edges of the document to be inserted, the window envelope modifier of the present invention can be used in its folded form either at a vertical edge of the document as shown in FIG. 1, or to hold the upper longitudinal edge of a document which has shorter vertical dimensions than the envelope, as in the case of the insert of FIG. 3. Similarly, the window envelope modifier can be used in its flat form in the manner illustrated in FIG. 3, not only to prevent upward movement of a vertically-shorter document away from the bottom edge of the envelope, as in FIGS. 3 and 4, but also to prevent lateral movement of an inserted document by using the modifier at a vertical edge of a document which happens to be shorter in longitudinal dimensions than the envelope, as in the case of the insert in FIG. 1. The use of the modifier in folded form, however, has definite advantages in facilitating the preassembly of the modifier with the desired edge of the document to be mailed. It avoids the necessity of more carefully manipulating a flat body portion to make sure that its precoated adhesive strip extends parallel to the desired document edge, but does not actually engage the document edge in a manner which could interfere with convenient manual removal of the document from the envelope or might leave a portion of the modifier remaining attached to the document. The modifier body may have substantially greater length than width, as illustrated, or may be more nearly square, e.g., 3½ to 3¼ inches long and 3½ inches wide, for convenient use within a standard no. 10 window envelope (9½ by 4⅛ inches).

The foregoing specification accordingly sets forth certain preferred embodiments and modifications of the invention and some of the ways in which the invention may be put into practice. Modifications of the described embodiments, as well as alternate embodiments and devices for carrying out the invention, may also be apparent to those skilled in the art, within the spirit and scope of the following claims.

I claim:

1. A window envelope modifier for selective manual insertion is previously manufactured standard window envelopes of various sizes at the time of and for the purpose of inserting and positioning a document of smaller size, i.e. having longitudinal and vertical outer edges at least one of which is shorter, when such document is prepared for mailing with the address of the recipient shown thereon, than the corresponding inside dimension of such a standard window envelope, such envelope having a window opening through which the address on said document is to be maintained in an externally visible position when the document is placed in such standard envelope with at least one of its longitudinal and vertical edges aligned and in engagement with the corresponding inside edge of the window envelope, said modifier being adapted for use when such a standard window envelope has at least one pair of opposite longitudinal and vertical inside edges spaced substantially farther apart than the spacing between the corresponding aligned edge and opposite edge of the document in a direction perpendicular to said aligned edge to an extent permitting possible undesired relative movement of the document between said inside envelope edges and a resulting loss of full visibility of the recipient's address through the window opening of the envelope, said modifier comprising a flat body portion having a construction and shape adapted for manual insertion in the standard window envelope to overlie a portion of the document opposite said aligned edge, and said modifier having retaining means for holding said document with its one edge in such aligned engagement, said retaining means including a strip of precoated adhesive on one surface of said flat body portion, said adhesive strip being positioned on said body portion at a location for selective engagement with at least one of said document and standard window envelope members to prevent shifting of the document away from the aligned inner edge of the envelope to a location where the address is not fully visible through the window opening, a removable cover strip initially adhered to and protecting said precoated adhesive strip and manually removable therefrom to expose the adhesive strip for use, said body portion being formed of sheet material having means providing a premarked fold line for folding the body portion on itself in one direction to provide opposed inner surfaces connected by a folded edge section for receiving the document edge which is opposite to such an aligned document edge and to provide opposite outer surfaces for gripping engagement to hold such aligned document edge temporarily within the folded edge for insertion of the modifier and document into aligned position inside the window envelope, and said precoated adhesive strip being positioned on the body portion parallel to said premarked fold line on the surface which is to constitute one of the opposite outer surfaces of the folded modifier for adhesive engagement with an inner surface of the envelope when the modifier and document have been inserted therein to such aligned position.

2. A window envelope modifier according to claim 1 in which the premarked fold line is offset from a center line toward one edge of the modifier to provide relatively longer and shorter surfaces at each side of such fold line, and in which the precoated adhesive strip is on the shorter outer surface.

3. A window envelope modifier according to claim 2 in which the sheet material is thin paperboard stock and the premarked fold line is a prescored fold line in said paperboard.

* * * * *

UNITED STATES PATENT AND TRADEMARK OFFICE

CERTIFICATE OF CORRECTION

PATENT NO. : 4,444,356

DATED : April 24, 1984

INVENTOR(S) : Walter L. Hays

It is certified that error appears in the above-identified patent and that said Letters Patent is hereby corrected as shown below:

Column 1, line 10, the word "is" should be--in--.

Column 2, line 15, the word "using" should be--along--.

Column 5, line 17, the number "3-1/4" should be--3-3/4--.

In the Claims:

Column 5, line 31, the word "is" should be--in--.

Signed and Sealed this

*Fourteenth* Day of *May 1985*

[SEAL]

*Attest:*

DONALD J. QUIGG

*Attesting Officer* *Acting Commissioner of Patents and Trademarks*